United States Patent [19]

Riegelman

[11] 4,202,136

[45] May 13, 1980

[54] DUAL SLIDING SASH SECURITY WINDOW

[75] Inventor: Harry M. Riegelman, Diamond Bar, Calif.

[73] Assignee: Rusco Industries, Inc., Fullerton, Calif.

[21] Appl. No.: 19,099

[22] Filed: Mar. 9, 1979

[51] Int. Cl.[2] ..... E05D 13/04

[52] U.S. Cl. ..... 49/449; 49/370; 292/114; 292/DIG. 46

[58] Field of Search ..... 49/449, 370; 292/114

[56] References Cited

U.S. PATENT DOCUMENTS

| | | | |
|---|---|---|---|
| 1,612,249 | 12/1926 | Anderson | 49/370 |
| 4,106,239 | 8/1978 | Bancroft et al. | 49/449 |

*Primary Examiner*—Kenneth Downey
*Attorney, Agent, or Firm*—Perry E. Turner

[57] ABSTRACT

A window structure is disclosed wherein the center portion includes sliding panels which have stiles in abutment in their closed positions, such stiles having plates or ribs extending from their inner surfaces which are captured and releasably held by a latch mechanism that is pivotal on one rib and slidable along it. On the exterior of the structure, one of the stiles carries a plate that spans equal areas of both abutting stiles. The latch is symmetrically contoured, whereby observation from either side of the structure does not clarify the edge portion and direction of movement of such portion of the latch that is required in order to operate the latch and permit the sashes to be moved apart. Further, the exterior plate prevents insertion of a tool between the abutting stiles when the sashes are in closed position and latched. The latch is spring biased to closed position, and has a cam surface which functions upon closing the sashes to be deflected by the rib of the other stile as it moves to stile-abutting position, and the latch moves to releasable locking relation with such camming stile after the deflection and the stiles reaching abutment. A weatherstrip is carried by the stile to which the exterior plate is not fixed, and sealingly engages such exterior plate in the closed positions of the sashes, thereby preventing entry of moisture and dirt between the abutting stiles.

6 Claims, 4 Drawing Figures

DUAL SLIDING SASH SECURITY WINDOW

BACKGROUND OF THE INVENTION

1. Field of the Invention

This invention relates to dual sliding windows and panels, including such sashes for vehicles.

2. Description of the Prior Art

Considerable time, effort and expense have been devoted to improving sliding sash structures for better security. In dual sliding window structures heretofore known, an undesireable characteristic is the facility with which such structures permit the sashes to be manipulated and opened, e.g., via an instrument thrust between abutting stiles of sashes that are mounted in the same track of a frame. Such manipulation is also made possible in a minimum of time due to the ready determination of the latch arrangement and the direction from which to attempt to trip the latch so the sashes can be moved apart. The determinations of where to insert the tool and how to operate the latch can be made from both sides of the window structure in instances where both sides are viewable, e.g., where the structure is mounted in the rear panel of a truck cab and the parts can be viewed through the windshield and door windows as well as through the rear of the cab.

SUMMARY OF THE INVENTION

This invention embraces a dual sliding panel structure with stiles in abutment in closed position, wherein one stile carries an external plate adjacent to and spanning equal areas of the outer surfaces of both stiles, and the inner surfaces carry vertical ribs which are captured by a latch mechanism that is symmetrically contoured, the latch being pivotal on one rib and spring biased to closed position. With the plate spanning the abutting edges of the stiles and the latch being symmetrical, one is unable upon quick inspection to determine how the latch should be operated, and is prevented from inserting a tool between the abutting stiles. Also embraced is the latch being slidably mounted on the one rib, to permit it to be located in any desired vertical position, and the end portions being tapered to effect camming thereof by the other rib when the sashes are moved to closed position so as to effect automatic latching upon such movement to closure.

DESCRIPTION OF PREFERRED EMBODIMENT

Figure 1:
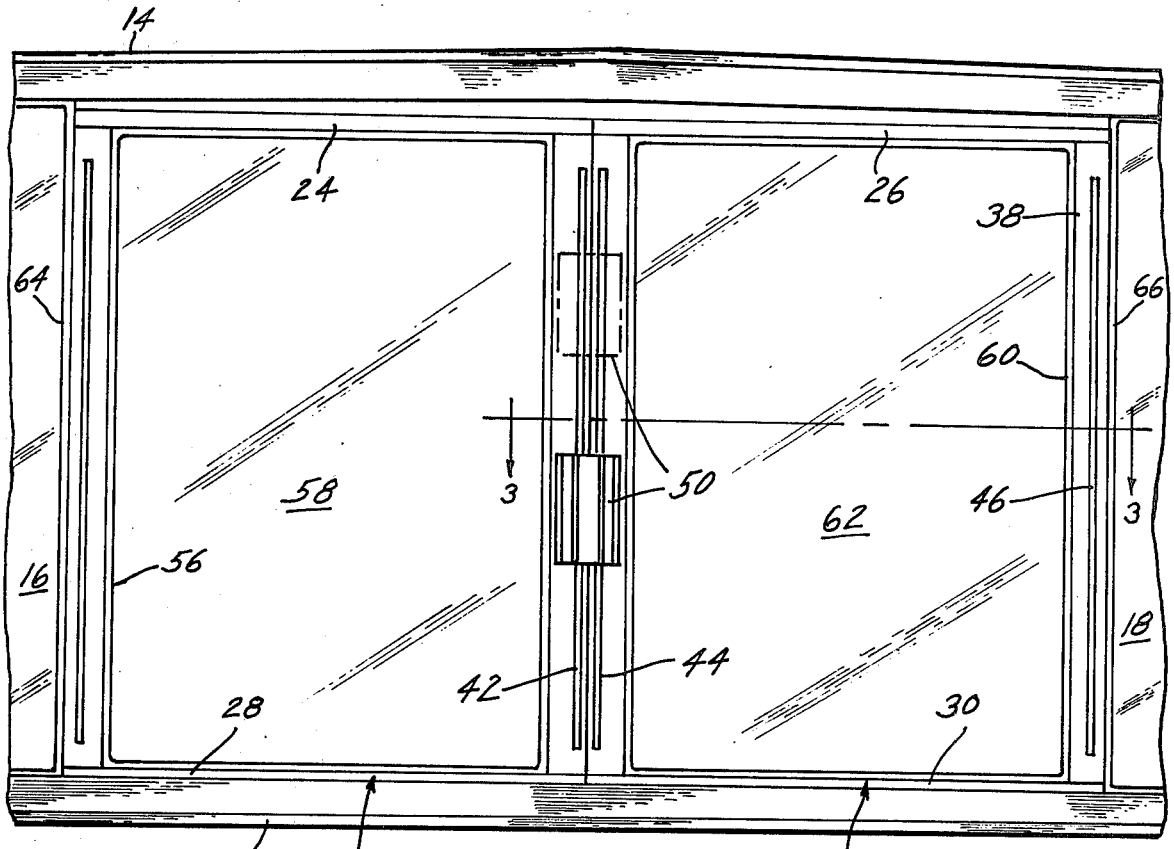
FIG. 1 is a fragmentary view in elevation of a window structure that includes dual sashes in accordance with this invention, as seen from the interior of the structure in which the window is mounted.

Referring to FIG. 1, there is shown a window structure 10 of the type suitable to be mounted in a vehicle, such as in the rear panel of a truck cab, having a straight lower frame section 12 and a curved upper section 14. Such frame carries stationary end panes 16, 18, between which panels or sashes 20, 22 are supported for horizontal movement.

The sashes 20, 22 have their upper rails 24, 26 extending partially into and in gliding relation to the upper curved frame section 14. Their lower rails 28, 30 are similarly slidable in the lower frame section 12. The sash 20 has its rails 24, 28 secured to stiles 32, 34, and the sash 22 has its upper and lower rails 26, 30 secured to stiles 36, 38. In the arrangement shown, the sash 20 has ribs 40, 42 extending inwardly from the inner surfaces of its stiles 32, 34, and the sash 22 similarly has ribs 44, 46 extending from the inner surfaces of its stiles 36, 38. The ribs serve as hand grip elements to be manually grasped and forced in the direction desired for opening and closing the sashes.

In the closed positions of the sashes, the abutting stiles 34, 36 are releasably held against sliding movement by a latch mechanism 50 that captures the ribs 42, 44 between edge portions thereof. As shown in solid line and phantom positions, the latch 50 can be moved vertically to any desired position and perform the desired latching function. Also shown in FIG. 1, the latch is symmetrical with respect to the plane in which the abutting edges of the stiles 34, 36 meet. Thus, observation of the front of the sashes, as through the windshield of a truck cab, provides no clue as to how to operate the latch in order to open the sashes.

Figure 2:
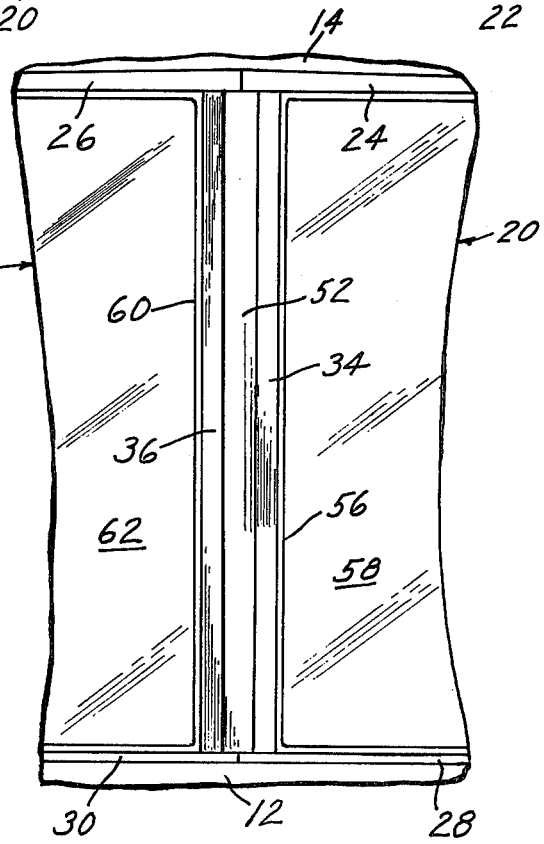
FIG. 2 is a fragmentary view in elevation of the window of FIG. 1 as seen from the exterior thereof.

Also, and referring to FIG. 2, the window structure as viewed from the exterior thereof has a plate 52 that extends the length of the sashes, and spans the abutting edges of the stiles 34, 36. The plate 52 spans equal areas of such stiles, and is also symmetrical with respect to the plane in which such abutting edges meet. Thus, the plate 52 prevents one from inserting a tool directly between the abutting stiles in an attempt to pry them apart from the exterior of the structure. Further, since the plate is symmetrical with respect to the abutting stiles, observation from the exterior of the structure provides no indication as to how to go about operating the latch so as to open the sashes.

Where such a window structure is used in a vehicle having a curved frame, it is preferred to incorporate means whereby sashes cannot be lifted out of the frame from either the inside or outside. For this purpose, reference is made to my copending application, "Vehicle Window With Non-Removable Sash in Curved Frame," Ser. No. 902,042, Filed May 2, 1978, which discloses anti-lift elements secured to the lower rails of a sash and which ride in the lower frame section, such elements and the frame having shoulders in interference relation so as to prevent removal of the elements, and hence the sash, from the frame.

Figure 3:
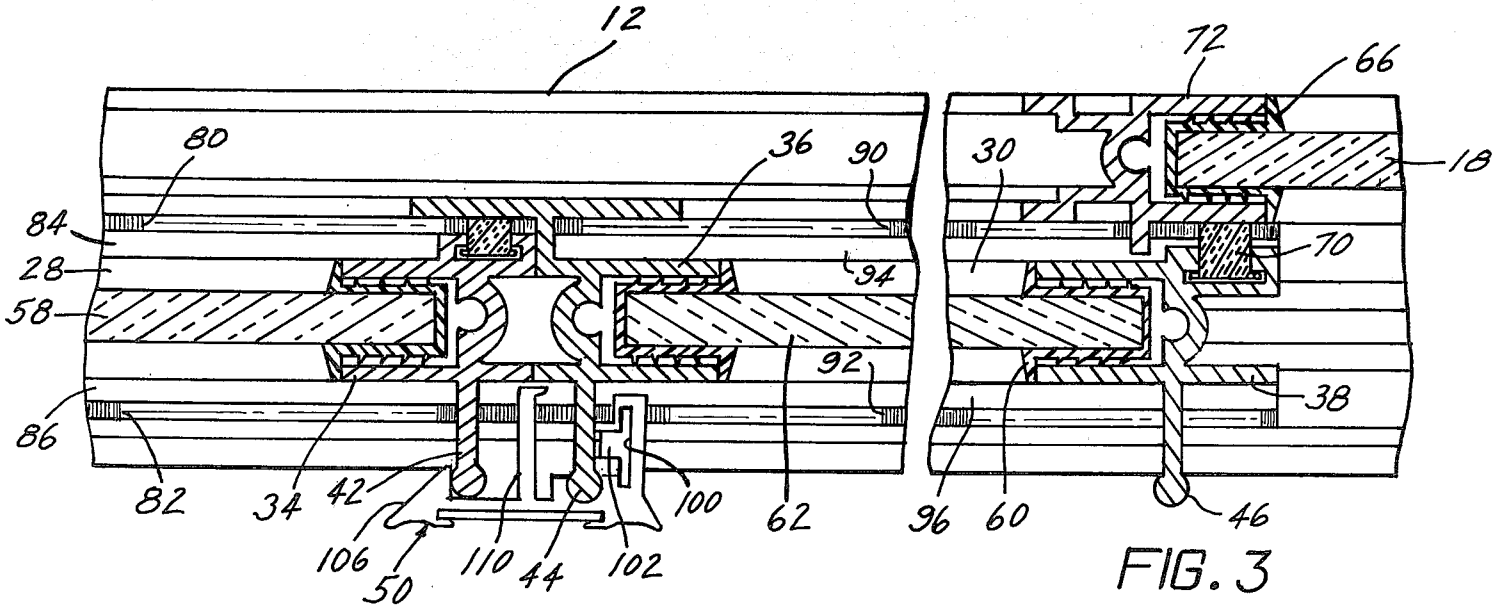
FIG. 3 is a fragmentary sectional view taken along the line 3—3 of FIG. 1.

Referring to FIG. 3 along with FIGS. 1 and 2, glazing is done with extruded gasket strips, as shown at 56 for a strip fitted around the edges of the pane 58 of the sash 20, at 60 for a strip fitted around the edges of the pane 62 of the sash 22, and at 64, 66 for strips fitted around the edges of the fixed panes 16, 18. The rails and stiles are sealed against entry of dirt and moisture past the sashes. Thus, as shown in FIG. 3, the outer face of the stile 38 of the sash 22 carries a weatherstrip 70 which, in the closed position of the sash, sealingly engages the inner surface of the stile 72 in which the fixed pane 18 is mounted. The sash 20 will be understood to carry such a weatherstrip in the corresponding stile 32.

Also, in the closed position of the sashes, the abutting stiles 34, 36 are sealed against entry of dirt and moisture past their abutting edges. To this end, the outer plate 52 is shown to be integral with one of the stiles 36, and the other stile 34 carries a weatherstrip 76 to sealingly engage the portion of the inner surface of the plate 52 adjacent the abutting edges of the stiles 34, 36. Since the weatherstrip 76 is inboard of the edge of the plate 52, its location is not quickly determined from observation. Further, if a person knew there was such a weatherstrip, he would have to spend valuable time determining where it is positioned. Even then, he still cannot pry the stiles apart because the construction limits the prying to the space between the parallel surfaces of the plate 52 and the adjacent stile, and such force is transverse to the direction of sliding movement of the sashes.

Further sealing means is provided via horizontal weatherstrips 80, 82 carried by the lower rail of the sash 20, as in channels 84, 86 secured to the outer and inner surfaces of the rail. Similar weatherstrips 90, 92 are carried in channels 94, 96 that are secured to the outer and inner surfaces of the rail 30 of the sash 22. It will be understood that similar horizontal weatherstrips carried by the upper rails of the sashes are similarly operable to sealingly engage the confronting surfaces of the frame portion in which the rails extend. Thus, the entire perimeters of the sashes are effectively sealed against entry of dirt or moisture.

Figure 4:
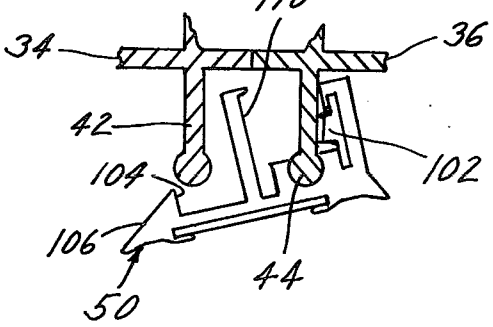
FIG. 4 is a fragmentary sectional view of the abutting stiles and ribs thereon, showing the latch mechanism in position for moving the sashes apart.

Referring to FIGS. 3 and 4 along with FIG. 1, the latch 50 is mounted on the outer portion of the rib of one of the abutting stiles. In the illustration, the outer portions of the ribs are rounded. The latch body adjacent one end has a groove to permit it to be matingly, slidably fitted on the rounded portion of such rib, which is the rib 44 of the stile 36 in this example, prior to assembly of the sash in the frame. The resulting ball-and-socket type coupling permits the latch to be rocked about the outer portion of the rib 44.

Adjacent the right face of the rib 44, the latch body has a channel groove 100 in which the flanged end of an elongated leaf spring 102 is captured. As shown in FIG. 3, the other end of the leaf spring 102 bears against the rib 44, and such spring normally biases the right edge portion of the latch clockwise about the rounded portion of the rib 44. The left edge portion of the latch is tapered like the right edge portion, and has a shoulder 104 which in the closed position of the sashes is in interference relation with the outer portion of the rib 42. Thus, in the closed position of the sashes, the latch is biased to the position in which the sashes cannot be separated.

The tapered surface 106 of the left edge portion of the latch can be grasped manually to pivot the latch counterclockwise to clear the rib 42, whereupon continued force directed to the right against such surface 106 is transmitted through the latch body and rib 44 to the sash, and the sash thereby moved to the right. If desired, such movement can be effect via force applied to either rib 44 or 46 while the latch is held in open position. The other sash can then be opened by applying force to either rib 40 or 42 to move it to the left.

The tapered surface 106 also functions to effect automatic camming of the latch in closing the sashes, and automatic latching of the ribe 42 when the stiles 34, 36 reach abutment. In this regard, when the sashes are moved apart, the released latch moves clockwise to a position wherein the surface 106 of the left edge portion is in the path of the rib 42 of the stile 34. To insure that the latch will not rotate past such position, it is provided with a rib 110 that is located to the left of the rib 44. As shown in FIG. 3, the inner edge of the rib 110 is adjacent the inner face of the stile when latching the sashes. When the sashes are apart, the inner edge of the rib 110 is adapted to move against the stile 36 and thereby limit further rotational movement due to the bias of the spring 102. Accordingly, when either sash is moved to closed position, movement of the other to such position results in the outer portion of the rib 42 striking the surface 106 to cam the latch counterclockwise. The spring 102 accommodates such movement, and immediately forces the latch again clockwise to force the left edge portion thereof inward and locate the shoulder 104 in interference relation with the rib 42 upon the stiles abutting each other. Such automatic latching is highly effective for security purposes, as when it is necessary to quickly close the sashes to prevent a person on the outside from reaching through with intent to commit an assault or other crime.

I claim:

1. In combination:

a window structure including a pair of sashes adapted for horizontal sliding movement, said sashes having respective stiles in abutment in the closes positions thereof, said stiles having vertical ribs extending from the faces thereof on one side of said structure;

a plate carried by one of said stiles on its opposite face, said plate being parallel to said opposite face and overlaying equal areas of said stiles;

and a latch mechanism carried by one of said stiles on the rib thereof, said latch mechanism including a latch element spanning both ribs, said ribs having enlarged outer portions, said latch element having one edge portion thereof slidable on said one stile, said latch element being symmetrically contoured with respect to the plane of abutment of said stiles;

said latch element having a shoulder to engage the rib of said other stile;

and means biasing said latch element toward the position of engagement by said shoulder of said other rib.

2. The combination of claim 1, including a weatherstrip carried by the outer face of the other stile and sealingly engaging said plate when said stiles are in abutment.

3. The combination of claim 2, wherein said plate and said latch plate are carried by the same stile.

4. The combination of claim 2, wherein the edge portions of said latch plate have surfaces tapering towards said ribs when said stiles are in abutment, said shoulder and the tapering surface meeting adjacent said other rib, and said last-mentioned tapering surface being in the path of said other rib when said stiles are apart, said other rib engaging said last-mentioned surface upon sliding said sashes to closed position and camming said latch plate around said one rib to permit said other rib to pass said shoulder, said biasing means being operable to move said latch plate and cause said shoulder to engage said other rib after it passes said shoulder and the stiles are in abutment.

5. The combination of claim 4, wherein said biasing means is an elongated leaf which at one end engages said one rib and has its other end captured by said latch plate.

6. The combination of claim 4, wherein said latch plate has an integral rib which in the abutting position of said stiles is spaced from the end of said one stile, said integral rib engaging said one stile when said stiles are moved apart, said integral rib being dimensioned to hold said latch plate so that said tapering surface engageable by said other rib for camming said latch plate is kept in the path of said other rib when said stiles are apart.

* * * * *